US007621014B2

(12) United States Patent
Katz

(10) Patent No.: US 7,621,014 B2
(45) Date of Patent: Nov. 24, 2009

(54) METHOD FOR CONTROLLING TWISTING OF POOL CLEANER POWER CABLE

(75) Inventor: Pesach Katz, Nahariya (IL)

(73) Assignee: Aquatron LLC, Delray Beach, FL (US)

( * ) Notice: Subject to any disclaimer, the term of this patent is extended or adjusted under 35 U.S.C. 154(b) by 0 days.

(21) Appl. No.: 11/529,966

(22) Filed: Sep. 29, 2006

(65) Prior Publication Data

US 2008/0078039 A1 Apr. 3, 2008

(51) Int. Cl.
*E04H 4/16* (2006.01)

(52) U.S. Cl. ..... 15/1.7; 15/319

(58) Field of Classification Search ..... 15/1.7; 210/167.14, 167.15, 167.2, 85, 91, 136, 143; 134/56 R, 57 R
See application file for complete search history.

(56) References Cited

U.S. PATENT DOCUMENTS 4,786,334 A * 11/1988 Nystrom ..... 134/21
5,507,058 A * 4/1996 Minami et al. ..... 15/1.7
5,569,371 A 10/1996 Perling
6,299,699 B1 10/2001 Porat et al.
6,412,133 B1 * 7/2002 Erlich et al. ..... 15/1.7
6,448,494 B1 9/2002 Erlich et al.
6,543,146 B2 4/2003 Smith et al.
6,665,900 B2 * 12/2003 Wichmann et al. ..... 15/1.7
6,758,226 B2 * 7/2004 Porat ..... 134/56 R
6,815,918 B2 11/2004 Porat et al.
6,842,931 B2 * 1/2005 Porat et al. ..... 15/1.7
6,842,991 B2 1/2005 Levi et al.
2007/0094817 A1 * 5/2007 Stoltz et al. ..... 15/1.7

* cited by examiner

*Primary Examiner*—Dung Van Nguyen
(74) *Attorney, Agent, or Firm*—Abelman, Frayne & Schwab

(57) ABSTRACT

An apparatus and method is provided for removing undesired twists and loops in a power supply cable attached to a robotic swimming pool cleaner during the cleaner's pre-programmed movement over the bottom and/or side walls of the pool. An on-board electronic compass determines an initial reference directional heading of the pool cleaner and the subsequent true or actual directional heading of the pool cleaner is determined intermittently or continuously as the pool cleaner moves through the program cycle. The subsequent directional headings of the moving pool cleaner are compared to the reference directional heading to provide a cumulative positive or negative value. When the cumulative value indicates that one or more complete 360° turns have been made from the reference directional heading, a correction signal is generated for immediate or delayed transmission to the directional control means to turn the pool cleaner in a direction to remove any twists or loops that have formed in the power cable.

15 Claims, 10 Drawing Sheets

METHOD FOR CONTROLLING TWISTING OF POOL CLEANER POWER CABLE

FIELD OF THE INVENTION

The present invention relates to a method and a pool cleaner for removing and preventing undesired twists and coils of the pool cleaner's power cable.

BACKGROUND OF THE INVENTION

Self-propelled automated, or robotic pool cleaners are designed to traverse either a pre-programmed pattern or a random path across the bottom of a swimming pool for the purpose of cleaning the bottom, and in some cases, also the sidewalls of the pool. The submerged cleaner receives its power through a buoyant power supply cable, or power cable, attached to a fixed or portable poolside power supply located in the proximity of the pool.

During operation of the pool cleaner, the repetitive turning movement of the cleaner as it moves from one sidewall of the pool to another has a tendency to form twists and coils in the floating power cable. If the size and configuration of the pool is known, it is possible to pre-program the operation of the pool cleaner to periodically reverse the pattern of movement in order to remove the twists that were formed in a prior programmed pattern of movement. However, this option is not always provided even in preprogrammed pool cleaners, and is simply not possible in pool cleaners that are designed to move in a random path.

In the case of swimming pools that are not rectangular, such as circular and elliptical pools, and those with an inclined bottom, even the pool cleaner moving according to a preprogrammed pattern can deviate from the preprogrammed pattern. Once the directional heading of the pool cleaner deviates from the preprogrammed pattern, subsequent movement of the pool cleaner is not properly controlled so that the twisting and coiling in the power cable become excessive. As the twists and coils are formed in the power cable, they have the effect of reducing the ability of the cable to extend its full length as is required to follow the intended preprogrammed pattern of the submerged moving cleaner.

Furthermore, if the twisting continues, the intended movement of the cleaner along a preprogrammed path is interrupted, with the result that the cleaner cannot complete its cleaning cycle. In some cases, the cleaner is displaced from the bottom or sidewall of the pool and becomes disabled or damaged by not being properly oriented. For example, if the pool cleaner is caused to float upside down to the surface of the pool, its intake system may no longer be able to draw in the water that is necessary to cool the one or more motors that power the pumps and/or the mechanical drive mechanism, thereby resulting in damage to the motor and necessitating expensive repairs.

It is therefore an object of the present invention to provide an efficient and easy to use apparatus and method for removing the undesired twists and prevent disabling coils from forming in a pool cleaner power cable that are formed during use.

A further object of the invention is to provide a pool cleaner equipped with a novel electronic control means in association with a directional data source for use in moving the pool cleaner for the purpose of removing/preventing the undesired twists in a power supply cable of the pool cleaner which moves according to a preprogrammed pattern.

It is to be understood that the term "electronic compass" as used in the description of the invention is intended to include all types of compasses that can be adapted to produce an electronic signal corresponding to a variation from the reference bearing, e.g., a distinguishable clockwise or counter-clockwise deviation that can be transmitted and stored. These compasses can include magnetic sensors, gyroscopic compasses, those based on micro-electro-mechanical systems (MEMS) technology, and others.

SUMMARY OF THE INVENTION

The above objects, as well as other advantages described herein, are achieved by providing a pool cleaner which moves on the bottom and, optionally, the sidewall surfaces of a swimming pool according to a scanning algorithm with means for determining if the power supply cable extending to the remote power source has developed one or more twists or loops and, if so, turning the pool cleaner in a direction that will remove the twists from the power supply cable. The pool cleaner of the present invention comprises a housing, a power supply cable extending from the housing for attachment to a remote power supply, an on-board memory device, an electronic compass, a microprocessor and a directional controller. The electronic compass can be, for example, a magnetic sensor, a micro-electro-mechanical system and a gyroscopic compass, and preferably includes a tilt sensor that compensates for any adverse effects caused by pitching and rolling of the pool cleaner as it moves.

The memory device stores the scanning algorithm, a reference heading and true directional headings of the pool cleaner, and data corresponding to the difference between the reference heading and the true directional headings of the moving pool cleaner.

The electronic compass is secured to the housing or other fixed structural member and is operatively coupled to the memory device and determines the initial or reference, optionally directional heading and subsequent true or actual directional headings of the pool cleaner that are tilt-compensated in order to reflect the pitch and/or roll of the electronic compass. The electronic compass transmits the reference heading and true or actual directional headings to the memory device.

The microprocessor is operatively coupled to the memory device and the electronic compass. The microprocessor compares the subsequent directional headings of the pool cleaner with the reference directional heading stored in the memory device, and transmits the result of each comparison in the form of a positive or negative value to represent, respectively, a right or left deviation from the reference directional heading in degrees. The microprocessor registers the completion of an entire turn either in a number of right turns or a number of left turns depending upon the left or right deviation from the reference directional heading, when the cumulative difference between the subsequent true directional headings and the reference directional heading is equal to or greater than 360°.

The directional controller is mounted on the housing operatively coupled to the microprocessor. The directional controller turns the pool cleaner to the left when the number of right turns is greater than the number of left turns and turning the pool cleaner to the right when the number of right turns is smaller than the number of left turns, until the number of the right and left turns are equalized.

In a preferred embodiment, the electronic compass includes a tilt sensor for sensing the pitch and the roll of the electronic compass and the reference heading and the true directional headings are tilt-compensated for the pitch and/or the roll. A tilt sensor is not required if the bottom surface of the pool is substantially horizontal or pools that have only a moderate slope. Such pools include lap pools, hotel and resort pools having depths that vary only by one or two feet.

Suitable electronic compasses, including those that have tilt-compensation functions are commercially available from Honeywell Corporation, Honeywell Solid State Electronics Center in the United States.

In one embodiment, the scanning algorithm is interrupted for the purpose of equalizing the number of right and left turns when the difference is equal to, or greater than a predetermined number of turns. In a preferred embodiment, the scanning algorithm is interrupted when the cumulative difference between right and left turns is equal to at least two complete turns of 360° each.

In another embodiment, the number of turns is equalized after the scanning algorithm has completed a cleaning cycle. That is, any loops or twists that are indicated by the corresponding number of turns required to bring the value back to zero, or substantially less than 360°, are removed when the pool cleaner starts up after completion of a cleaning cycle. In a preferred embodiment, the number of turns required to achieve equalization is stored in the memory device after a cleaning cycle has been completed and the turn, or turns are completed after the pool cleaner is powered up in preparation for the next cleaning cycle.

In another aspect of the present invention, the above objects are achieved by a method for removing and preventing undesired twists and loops in a pool cleaner power supply cable extending between a remote power supply and a self-propelled pool cleaner. The pool cleaner moves on the bottom and/or side walls of a swimming pool according to a scanning algorithm directed by a microprocessor on board the pool cleaner. A directional controller on board the pool cleaner changes the directional heading of the pool cleaner in response to signals from the processor. A memory device operatively coupled to the processor stores the scanning algorithm.

According to the method, the swimming pool cleaner is provided with an electronic compass and a tilt sensor operatively connected to the processor which determines the true directional heading of the pool cleaner. The tilt sensor senses the pitch and the roll of the electronic compass and the true directional heading is a tilt compensated heading by the pitch and roll.

A reference directional heading of the pool cleaner is transmitted to the memory device and the reference directional heading is determined by the electronic compass upon initiation of the scanning algorithm. The true directional heading of the pool cleaner is transmitted to the memory device during the scanning.

Each of the subsequent true directional headings of the pool cleaner is compared with the reference directional heading. The result of each comparison is transmitted in the form of a positive or negative value to represent, respectively, a right or left deviation from the reference directional heading in degrees. The completion of an entire turn is registered either in a number of right turns or a number of left turns depending upon the left or right deviation from the reference directional heading, when the cumulative difference between the subsequent true directional headings and the reference directional heading is equal to or greater than 360°.

The pool cleaner is turned to the left when the number of right turns is greater than the number of left turns and is turned to the right when the number of right turns is smaller than the number of left turns, until the number of the right and left turns are equalized. That is, the memory device reflects a positive or negative value of degrees that is less than plus or minus 360°.

The scanning algorithm can be interrupted for the purpose of equalizing the number of right and left turns when the difference is equal to or greater than a predetermined number of turns. In a preferred embodiment, the scanning algorithm is interrupted when the difference between right and left turns is equal to at least two.

The number of turns can also be equalized after the scanning algorithm has completed the cleaning cycle and when the pool cleaner is powered up in preparation for the next cleaning cycle.

In still another aspect of the present invention, the above objects are achieved by another method for removing and preventing undesired twists and coils in a pool cleaner power supply cable extending between a remote power supply and a self-propelled robotic pool cleaner. The pool cleaner moves on the bottom and/or side walls of a swimming pool according to a scanning algorithm directed by a microprocessor on board the pool cleaner. The directional controller on board the pool cleaner changes the directional heading of the pool cleaner in response to signals from the processor.

According to the method, the swimming pool cleaner is provided with an electronic compass operatively connected to the processor for determining the true directional heading of the pool cleaner. A reference directional heading of the pool cleaner is transmitted to the memory device as determined by the electronic compass upon initiation of the scanning algorithm. The true directional heading of the pool cleaner is determined during movement of the pool cleaner in accordance with a scanning algorithm after the reference heading of the pool cleaner is determined and entered in the memory device.

The difference is calculated in degrees between the reference directional heading and the true directional headings of the pool cleaner. Added or subtracted is a counter value by one, the absolute value of which indicates number of turns relative to the reference directional heading and the sign of which indicates the direction of the turns relative to the reference directional heading, whenever the cumulative difference between the reference directional heading and the true directional heading is equal to 360°.

The pool cleaner is turned in a direction corresponding to the counter value after the completion of the movement in accordance with the scanning algorithm to thereby reduce or eliminate the twists or coils formed in the power supply cable during movement of the pool cleaner.

It is to be understood that the use of the terms "true" and "actual" with reference to a directional heading are intended to by synonymous. It is also to be understood that a magnetic sensor is known to produce a true directional heading and that variations in the earth's magnetic field results in known deviations that must be corrected to arrive a true north bearing for macro-navigational purposes. However, for the purposes of the practice of the present invention, it is the measurement of the changes is direction following start-up of the pool cleaner is required.

BRIEF DESCRIPTION OF THE DRAWINGS

The teachings of the present invention can be readily understood by considering the following detailed description in conjunction with the accompanying drawings in which.

Figure 1:
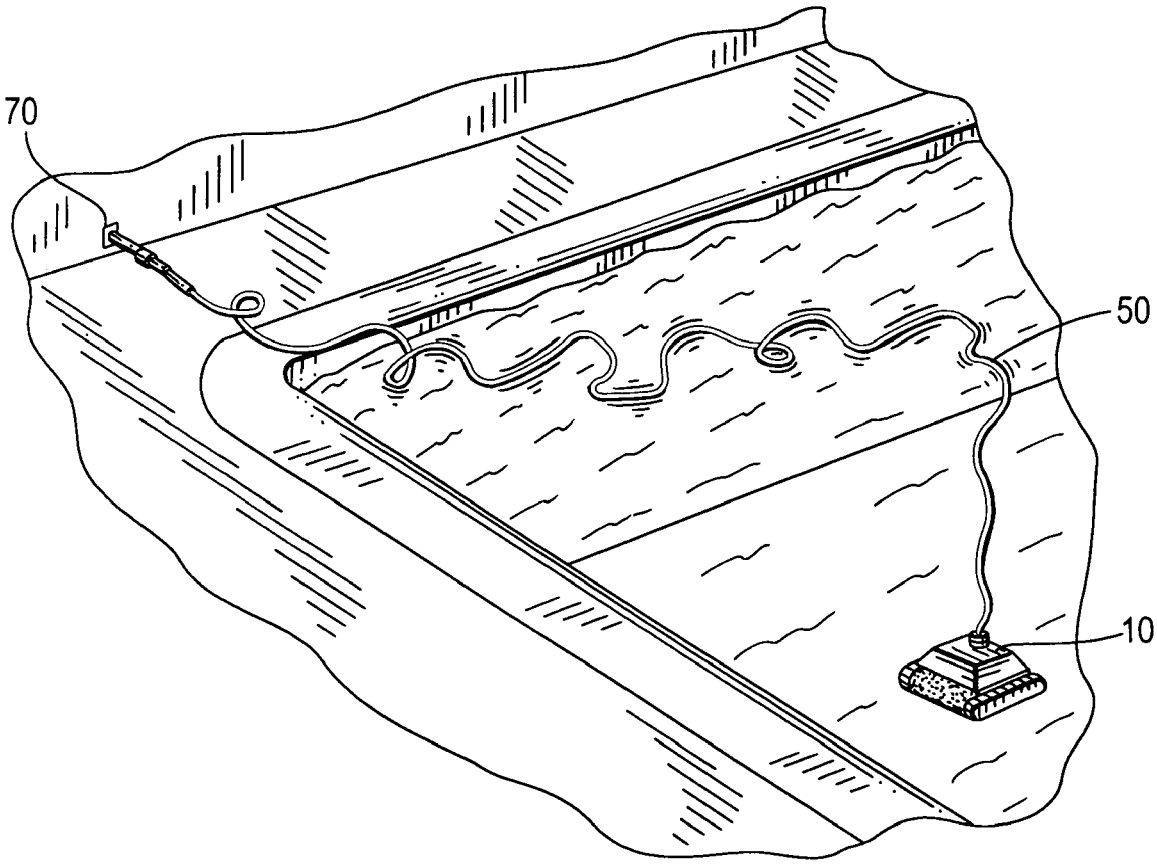
FIG. 1 is a top perspective view of a portion of a swimming pool showing an operating pool cleaner having a power cable.

To facilitate an understanding of the invention, the same reference numerals have been used, when appropriate, to designate the same or similar elements that are common to the figures. Unless stated otherwise, the features shown and described in the figures are not drawn to scale, but are shown for illustrative purposes only.

DETAILED DESCRIPTION OF THE INVENTION

As used in this description of the invention, the term "scanning" means the pre-programmed movement of the pool cleaner during its cleaning cycle and "scanning algorithm" means the program(s) entered in the processor for controlling the pool cleaner's movement during one or more cleaning cycles.

Referring to FIG. 1, a pool cleaner 10 is electrically connected via a power cable 50 to a remote poolside power supply 70. The power supply 70 can be a fixed or portable power supply located in the proximity of the pool. The power cable 50 attached to the submerged pool cleaner 10 is easy to be twisted during a cleaning operation, as shown in FIG. 1.

Figure 2:
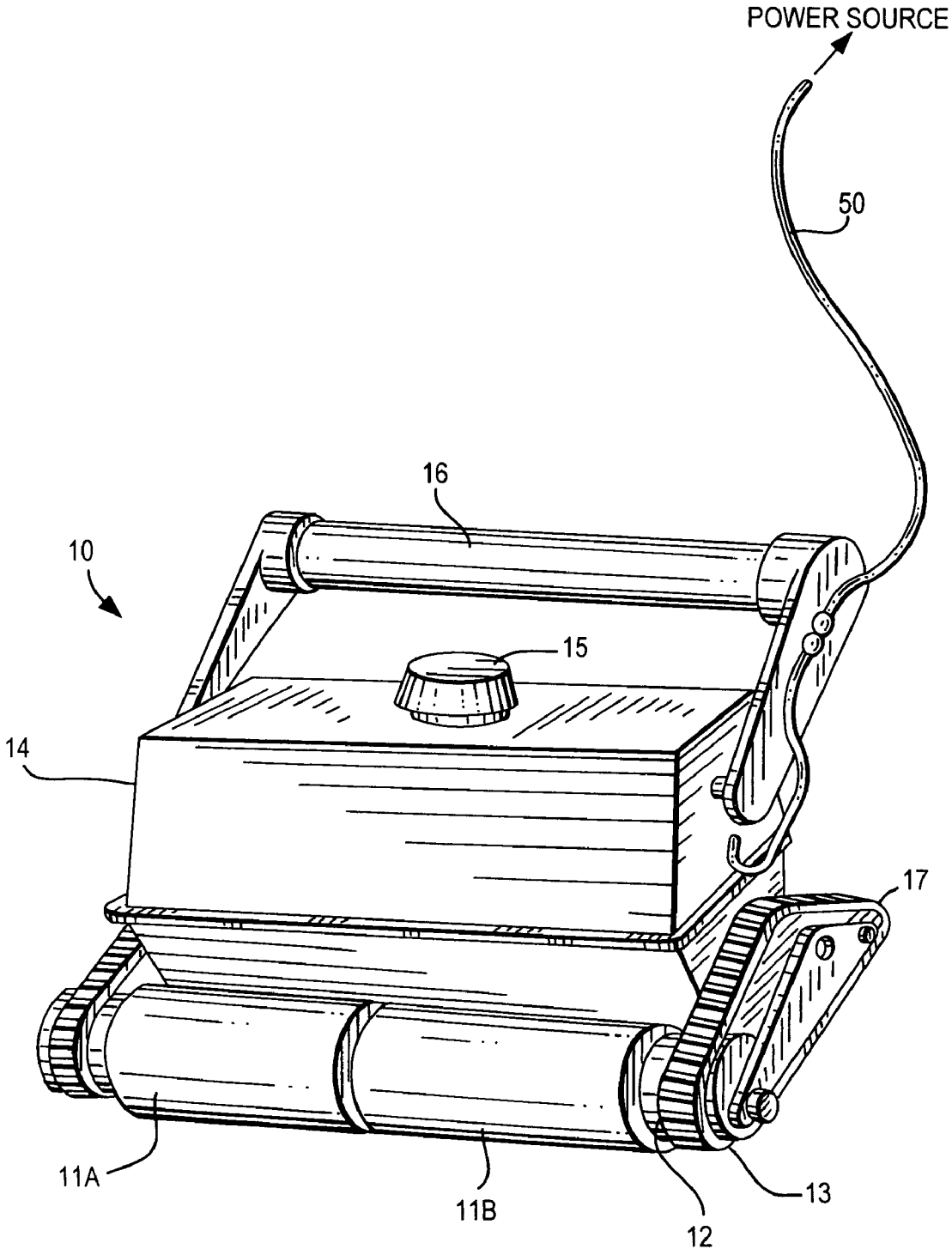
FIG. 2 is a top perspective view of one embodiment of a pool cleaner.

Referring to FIG. 2, the pool cleaner 10 comprises a housing 14 on which are mounted independently rotatable traction means 11A and 11B. The traction means 11A, 11B are roller brushes fabricated from a molded elastomeric polymer such as polyvinyl acetate, or PVA, that provides good traction for the pool cleaner 10 against ceramic tile pool bottoms and sidewalls. The roller brushes can also be constructed from an assembly of expanded foam and other materials that are well known in the art.

Figure 3:
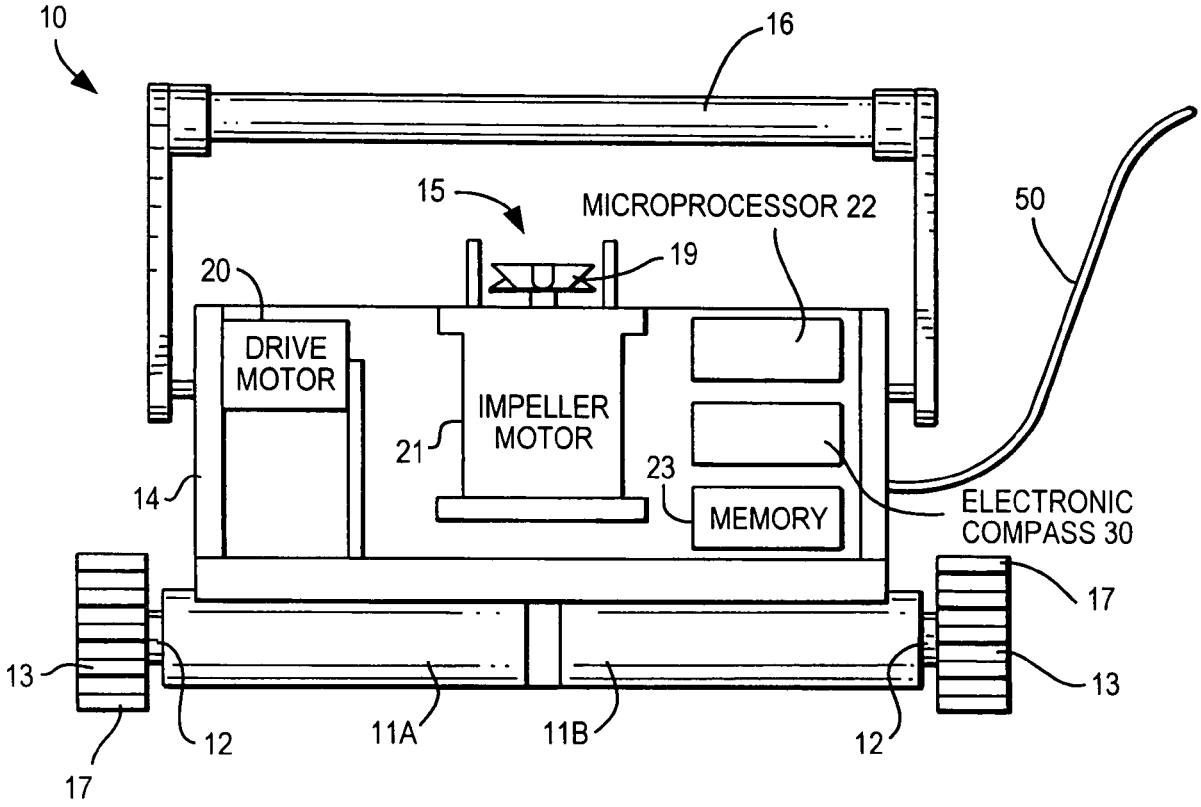
FIG. 3 is a side view of the pool cleaner of FIG. 2.

With further reference to FIG. 2 and FIG. 3, the traction means 11A, 11B are mounted for rotation on axles 12 extending transversely across either end of the cleaner and terminating in pulleys 17, which in this embodiment are outboard of the rollers 13. Pulleys 17 are preferably provided with transverse grooves and drive belts with corresponding lugs to engage the grooves to provide a non-slip power train from a drive motor 20, preferably a brushless DC motor. A differential rotation of the traction means 11A, 11B driven by the drive motor 20 allows the pool cleaner 10 to change a directional heading of the cleaner 10.

In a preferred embodiment, rotational support members or other locomotive means for the cleaner 10 can be used, such as wheels, and a combination of wheels and caterpillar tracks that enable the cleaner to move and change its directional heading.

Still referring to FIGS. 2 and 3, the housing 14 is fitted with a pump outlet 15 proximate the center of the top surface of the housing 14 and a carrying handle 16 pivotally secured to side surfaces of the housing 14. Also mounted in the housing 14 is a conventional impeller motor 21 with attached impeller 19 that draws water through a filter element (not shown) and discharges the filtered water through the outlet 15. The filtered water expelled by the impeller 19 produces an opposing force that maintains the traction means 11A, 11B in contact with the bottom, or in another preferred embodiment, the sidewall, of the pool. As will be understood by one of ordinary skill in the art, the flow of water through this otherwise conventional pool cleaner housing is through intake openings at the lower portion of the housing and/or base plate and upwardly through a filter where debris is removed and entrained; the water is then discharged through the outlet 15.

Figure 4:
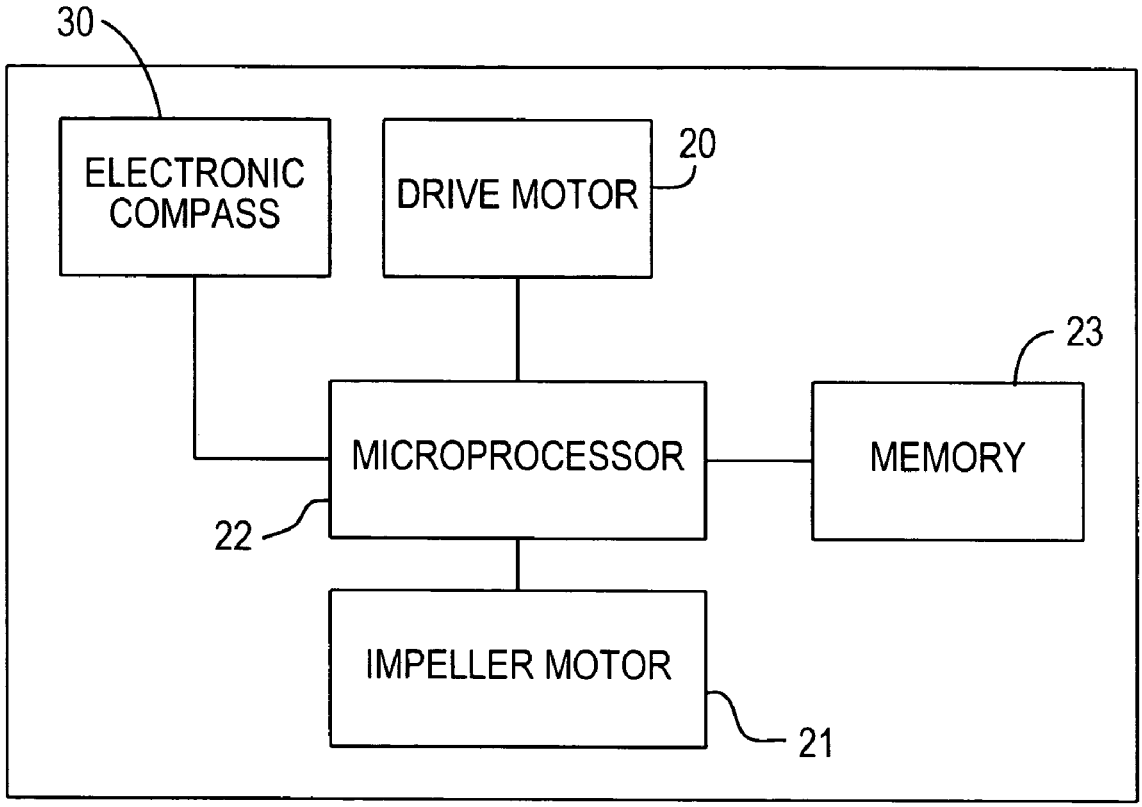
FIG. 4 is a schematic diagram of elements in the pool cleaner of FIG. 3.

Referring to FIGS. 3 and 4, a microprocessor 22 is connected to and controls the drive motor 20, the impeller motor 21, a memory 23 and an electronic compass 30. The microprocessor 22 is supplied with a power source from the power cable 50 attached to the external surface of the housing 14. The memory is, preferably, non-volatile memory, such as read only memory (ROM).

The electronic compass 30 mounted inside the housing 14 defines a directional heading of the pool cleaner 10 based on which the twists in the power cable 50 would be removed. In a preferred embodiment, the electronic compass 30 is level with the bottom surface of the housing 14 for the accurate sensing of the directional heading of the cleaner 10. Preferably, the electronic compass 30 is constructed based on the article entitled "Applications of Magnetic Sensors For Low Cost Compass Systems" by Michael J. Caruso, Honeywell SSEC, Apr. 18, 2002, the entire disclosure of which is incorporated herein by reference.

Figure 5:
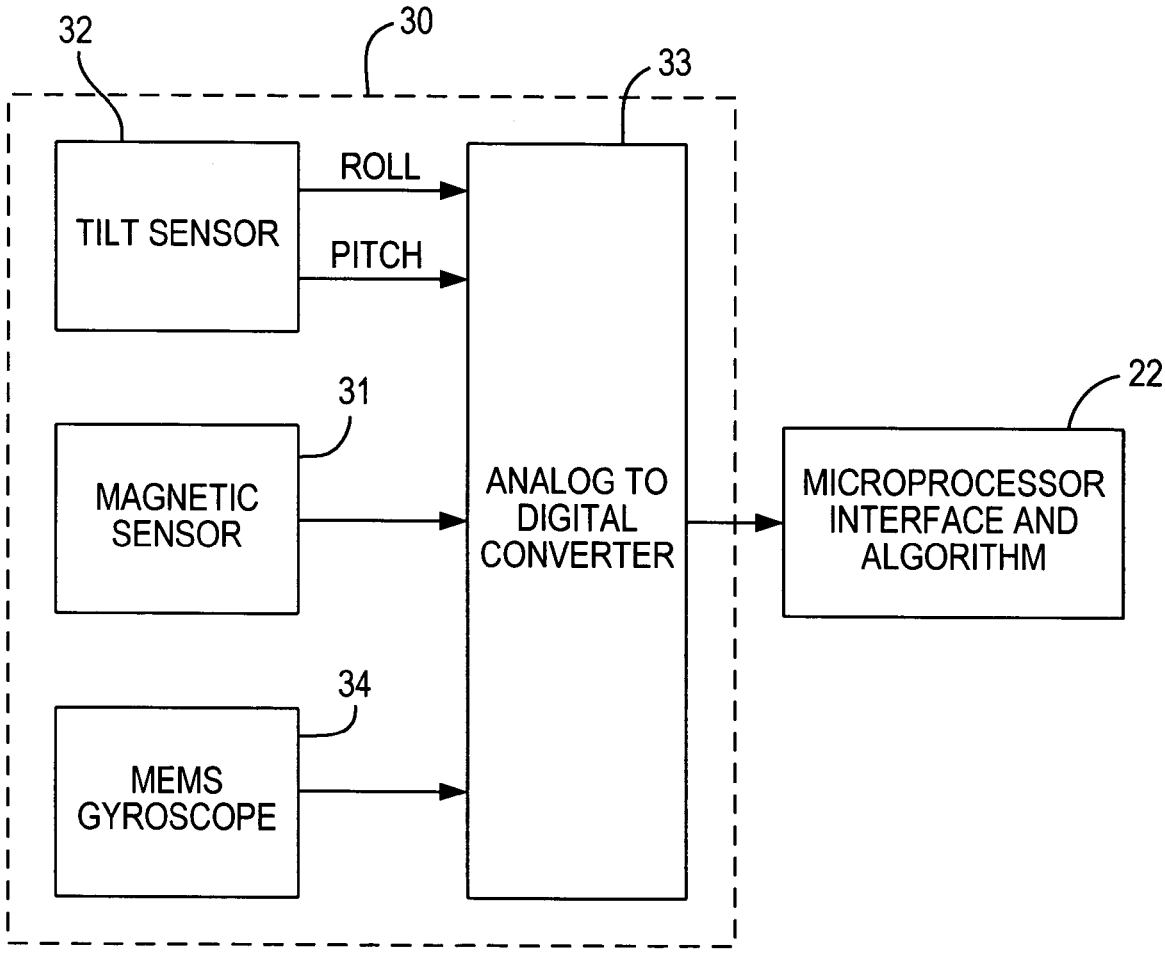
FIG. 5 is a schematic diagram of an embodiment of an electronic compass.
Figure 6:
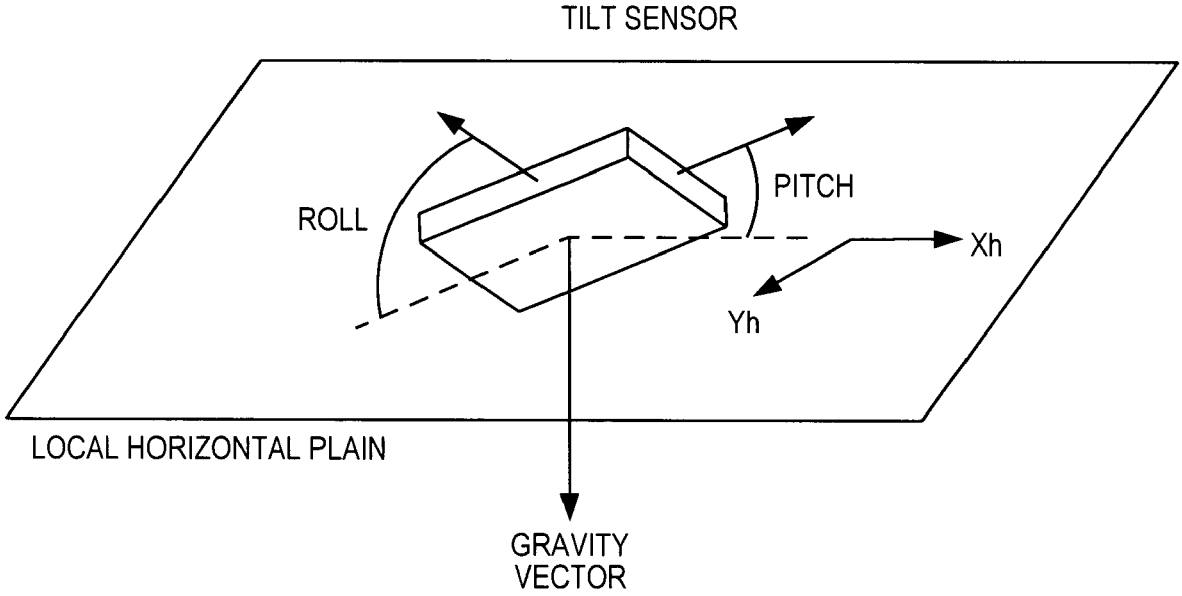
FIG. 6 is an illustration of the conception of a pitch and a roll.

Referring to FIGS. 5 and 6, the electronic compass 30 includes magnetic sensors 31 fixed on the housing 14 for sensing the magnetic field with respect to a three-axis internal coordinate system as depicted in FIG. 6, and tilt sensors 32 for sensing a pitch and a roll. The pitch is the angle between the pool cleaner's longitudinal axis and the local horizontal plane and the roll is the angle about the longitudinal axis between the local horizontal plane and the actual pool cleaner's directional heading, both of which represents how much the pool cleaner 10 equipped with the electronic compass 30 is tilted from the local horizontal plane. The local horizontal plane is the plane normal to the gravity vector and a reference plane for the electronic compass 30 to determine a tilt compensate directional heading.

Still referring to FIG. 5, an analog to digital (A/D) converter 33 is coupled to directional sensing circuitry, such as the tilt sensors 32 and the magnetic sensors 31, and converts analog data sensed by the magnetic sensors 31 and the tilt sensors 32 into digital data and provides the converted digital data to the microprocessor 22, which performs all calculations for determining the directional heading of the pool cleaner 10.

It should be noted that micro-electro-mechanical systems (MEMS') gyroscope 34 can measure a directional heading of the pool cleaner instead of or in combination with the magnetic sensors 31. The magnetic sensors 31 provide absolute heading information without respect to a time history of motion. The MEMS gyroscope 34 does not measure angular displacement directly, but rather the rate of angular motion, and a mathematical integration of angular rate with respect to time then produces a relative angular displacement or azimuth. This relative angular displacement indicates a relative orientation from an initial directional heading of the pool cleaner. The information from the gyroscope 34 can, by itself, be used to generate directional heading information. Once a starting orientation is provided, the angular change rate from the gyroscope may be mathematically integrated with time, to provide a directional heading reflecting the motion of the gyroscope itself. The resulting information can then be used as an alternative to data from magnetic sensors 31.

If the pool cleaner 10 is level with the local horizontal plane, only magnetic fields sensed by the magnetic sensors 31 or changes sensed by the gyroscope 34 can provide the directional heading of the pool cleaner 10 without regard to the pitch and the roll. The directional heading of the pool cleaner in this case is determined as follows:

$$\text{Directional Heading}=\arctan(Yh/Xh),\ \text{where Xh and Yh represent the earth's horizontal magnetic field components.} \quad (1)$$

On the other hand, when the pool cleaner 10 is not level with the local horizontal plane, the magnetic fields sensed by the magnetic sensors 31 needs to be tilt compensated using the pitch and the roll sensed by the tilt sensors 32 to determine the earth's magnetic field components on the local horizontal plane. The earth's horizontal magnetic field components in this case are determined as follows:

$$Xh=X\cos(\phi)+Y\sin(\theta)\sin(\phi)-Z\cos(\theta)\sin(\phi)\ \text{and} \quad (2)$$

$Yh=Y\cos(\theta)+Z\sin(\theta)$, where X, Y, Z are components of the earth's magnetic fields on the three-axis, and $\theta$ and $\phi$ are the roll and the pitch. The directional heading is determined by the equation (1).

The directional heading data are stored in the memory 23 for use in the subsequent determination of directional heading. The memory 23, which also stores the scanning algorithm of the movement of pool cleaner 10 and directional headings of the pattern, can be integrated into or separate from the microprocessor 22 or the electronic compass 30.

The above tilt compensation is performed by the microprocessor 22. The microprocessor circuitry 22 can be integrated with any such circuitry in the electronic compass 30 and then appropriately programmed to perform all the necessary functions of both. Alternatively, the microprocessor circuitry may be maintained separately.

Figure 7:
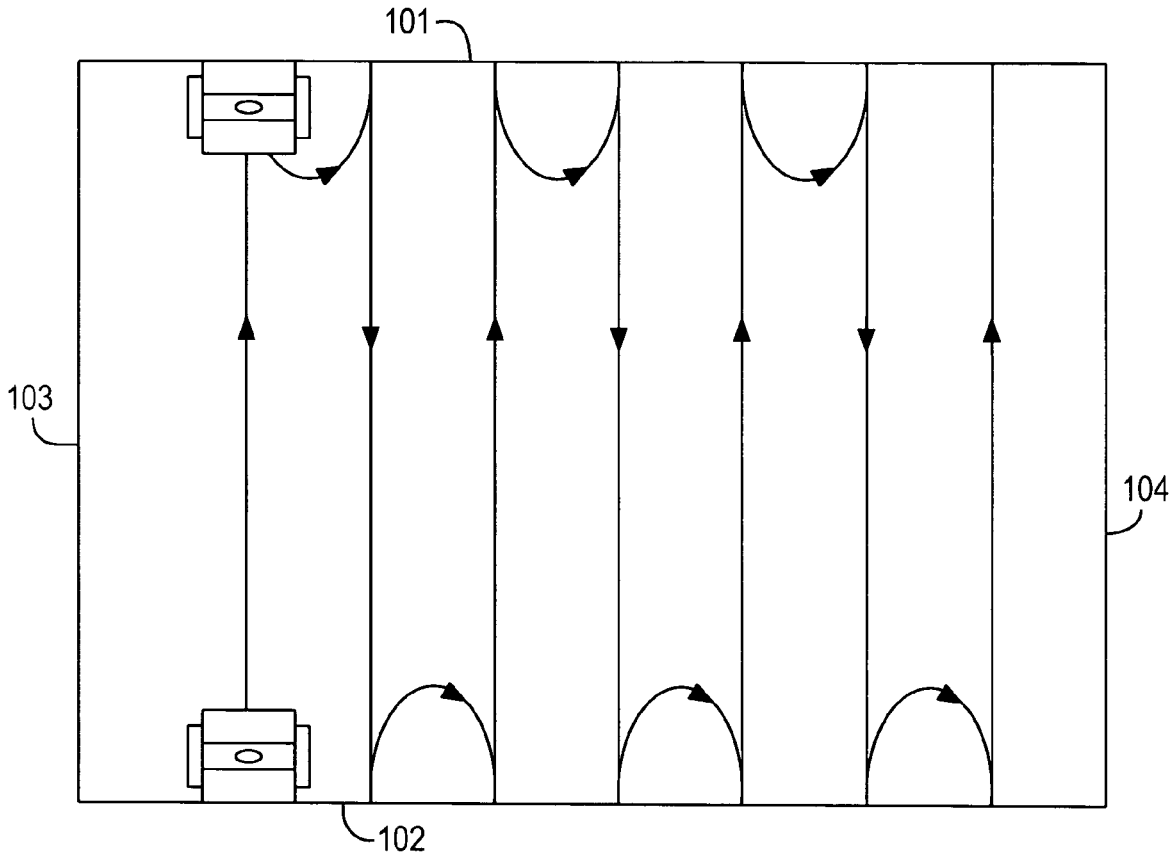
FIG. 7 is a plain view of a swimming pool schematically illustrating the path of a pool cleaner.

Referring to FIG. 7, there is shown a preprogrammed pattern of the movement of the pool cleaner 10 where the pool cleaner 10 traverses repetitively in a straight line parallel to the end wall 103 across the bottom between walls 101 and 102.

Figure 8A:
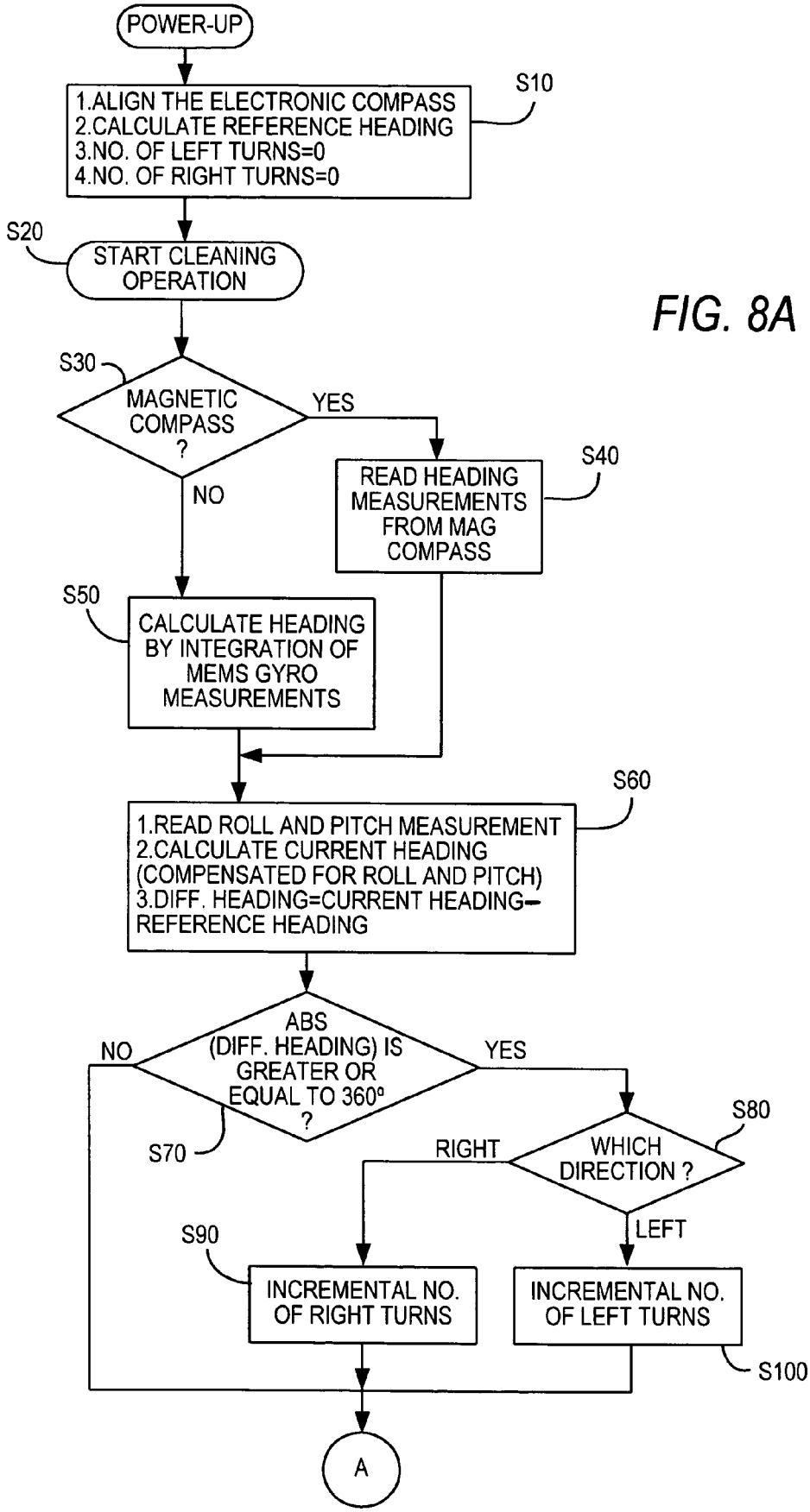
FIGS. 8A and 8B are flow diagrams of a procedure for removing and preventing twists in a pool cleaner power cable.
Figure 8B:
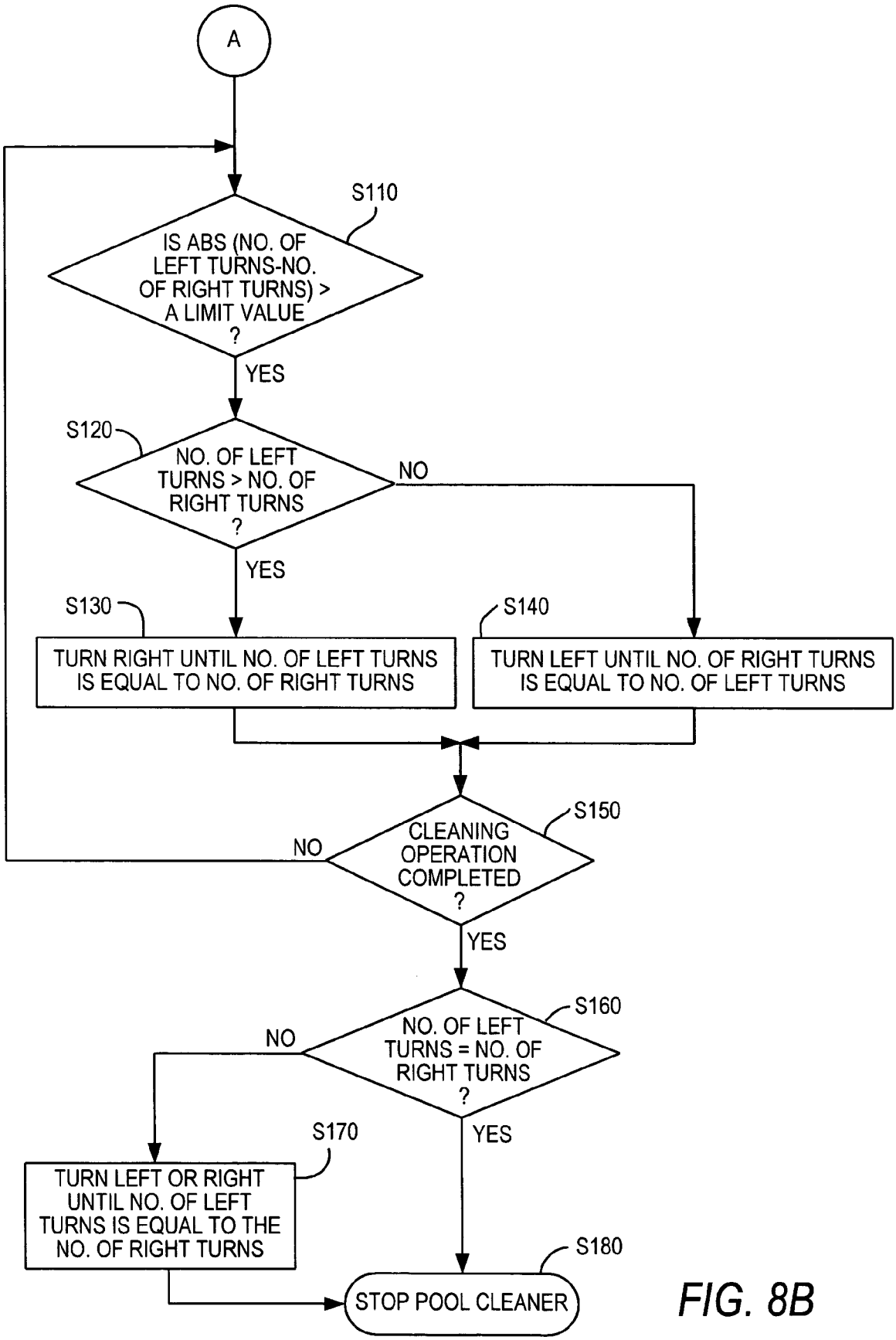

Referring to the flow chart of FIGS. 8 A and 8B, a procedure of removing and preventing twists in the power cable is described. Upon the powering up of the pool cleaner 10, the pool cleaner 10 is initialized. The electronic compass 30 is activated and the aligned compass 30 determines a reference directional heading of the pool cleaner 10, which becomes a reference for subsequent corrections of twists or coils in the power cable 50. (S10) The reference directional heading is transmitted to, and stored in the memory device 23. When the reference directional heading is determined, a number of left turns and a number of right turns that are to be used for indicating the amount and the direction of twists in the power cable 50 are set as zeros.

After the pool cleaner 10 is initialized, the pool cleaner 10 starts the cleaning operation. (S20) Referring to FIG. 7, the pool cleaner 10 starts to move on the bottom or a sidewall of the pool in accordance with the scanning algorithm stored in the memory device 23.

After the cleaning operation begins, true directional headings of the pool cleaner 10 are determined. The determination of the true directional headings can be performed continuously or intermittently. The magnetic sensors 31 or the MEMS gyroscopes 34 sense a directional heading of the pool cleaner 10, which, however, does not reflect the pitch and roll due to an undulating bottom.

It is determined which one between the MEMS gyroscope 34 and the magnetic sensors 31 measure the directional heading of the pool cleaner. (S30) If the magnetic compass is used, the heading of the magnetic compass is measured. (S40) When the MEMS gyroscope is chosen, the directional heading is measured by a mathematical integration of MEMS gyroscope measurements. (S50)

Thus, the directional heading sensed by the magnetic sensors 31 or the gyroscope 34, as well as the pitch and roll sensed by the tilt sensor 32, in combination, defines a true directional heading of the pool cleaner 10. The true directional heading is compared to the reference heading of the pool cleaner and the difference between the true directional heading and the reference heading is calculated and stored in the memory 23. (S60)

Figure 9:
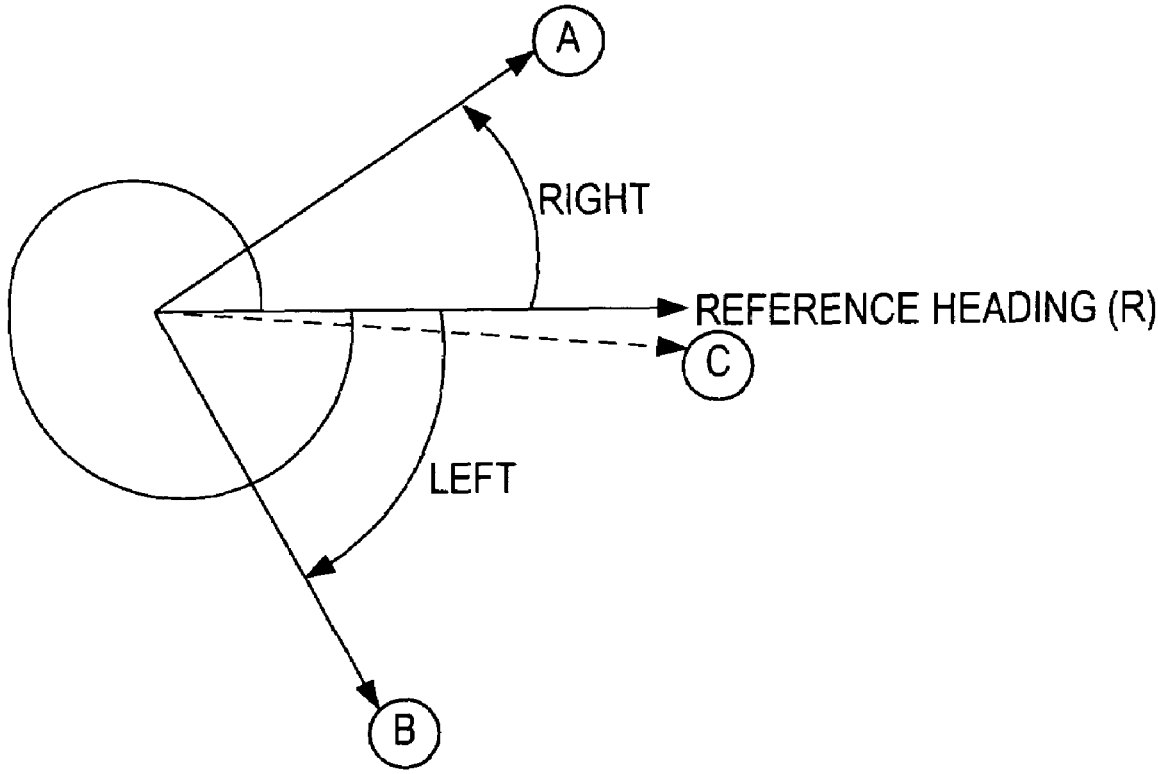
FIG. 9 is a schematic diagram conceptually illustrating the left turns and right turns for use in removing the twists in the power cable.

The microprocessor 22 retrieves the difference data from the memory 23 and determines whether the difference between the true directional heading and the reference heading is equal to or greater than 360°. (S70) Referring to FIG. 9, if the angular difference (c) between the true directional heading and the reference heading (R) is equal to or greater than 360°, the microprocessor 22 detects an entire turn of the pool cleaner relative to the reference heading and increases the number of right or left turns according to the direction relative to the reference heading. (S80) With continued reference to FIG. 9, if, for example, the right turn is set as counterclockwise in direction relative to the reference heading (R), the number of right turns is in creased by one upon the detection of the entire turn in the counterclockwise direction. (S90) On the other hand, the number of left turns is increased by one upon the detection of the entire turn in the clockwise direction. (S100) The number of right turns and the number of left turns are transmitted and stored in the memory device 23.

The cumulative number of right turns is compared with the cumulative number of left turns continuously during the cleaning operation. The microprocessor 22 determines whether the difference between the number of right turns and the number of left turns stored in the memory 23 is greater than a limit value. (S110) If the difference is greater than the limit value, it is determined whether the number of left turns is greater than the number of right turns. (S120) If the number of left turns is greater than the number of right turns, the pool cleaner 10 turns to the right until the number of left turns equals to the number of right turns. (S130) If the number of right turns is greater than the number of left turns, the pool cleaner turns to the left until the number of right turns equal to the number of left turns. (S140)

It is determined whether the cleaning operation is completed. (S150) If the cleaning operation does not end, the cleaning operation continues. If the cleaning operation is completed, the microprocessor 22 checks again whether the number of left turns stored in the memory 23 is equal to the number of right turns stored in the memory 23. (S160) If the number of right turns is not equal to the number of left turns, the pool cleaner 10 turns to the left or right until the number of right turns is equal to the number of left turns. (S170) If the number of left turns is equal to the number of right turns, the pool cleaner 10 stops the cleaning operation. (S180)

In a preferred embodiment, the number of right turns and the number left turns are stored in the memory device 23 before a power off of the pool cleaner 10. The changing of direct ional heading of the pool cleaner 10 is executed after a restart of the pool cleaner in accordance with the number of right turns and the number of left turns before a cleaning operation.

Although various embodiments that incorporate the teachings of the present invention have been shown and described in detail herein, those of ordinary skill in the art can readily devise other and varied embodiments and the scope of the invention is to be determined by the claims that follow.

I claim:

1. A method for removing and preventing undesired twists and coils in a pool cleaner power supply cable extending between a remote power supply and a self-propelled pool cleaner, the pool cleaner moving on the bottom and/or side walls of a swimming pool during a cleaning cycle according to a scanning algorithm directed by a microprocessor on board the pool cleaner, a directional controller on board the pool cleaner for changing the directional heading of the pool cleaner in response to signals from the processor, and a memory device operatively coupled to the processor for storing the scanning algorithm, the method comprising steps of:

a. providing the swimming pool cleaner with an electronic compass for determining the directional heading of the moving pool cleaner;

b. providing a tilt sensor for sensing the pitch and the roll of the electronic compass that is operatively connected to the processor for determining the actual directional headings of the pool cleaner, the actual directional heading being a pitch and/or roll compensated heading that corrects the directional heading for the effects of any pitch and/or roll experienced by the pool cleaner while moving;

c. transmitting an initial reference directional heading of the moving pool cleaner to the memory device as determined by the electronic compass upon initiation of the scanning algorithm;

d. transmitting sensed pitch and/or roll data to the microprocessor and calculating an actual directional heading as the pool cleaner moves across the pool surface being cleaned;

e. transmitting a series of actual directional headings of the moving pool cleaner to the memory device during the cleaning cycle;

f. comparing each of the series of actual directional headings of the pool cleaner with the reference directional heading and transmitting to the memory device for storage the result of each comparison in the form of a positive or negative value to represent, respectively, a right or left deviation value in degrees from the reference directional heading;

g. registering the completion of an entire turn either in a number of right turns or a number of left turns depending upon the left or right deviation from the reference directional heading, when the cumulative difference between the subsequent actual directional headings and the reference directional heading is equal to, or greater than 360°; and h. turning the pool cleaner to the left when the number of right turns is greater than a predetermined number of left turns and turning the pool cleaner to the right when the number of right turns is less than a predetermined number of left turns, until the number of the right and left turns are equalized, thereby minimizing undesired twists and coils in the pool cleaner power supply cable.

2. The method of claim 1 in which the scanning algorithm is interrupted for the purpose of equalizing the number of right and left turns when the difference is equal to one complete turn.

3. The pool cleaner of claim 1, wherein the electronic compass is selected from the group consisting of magnetic sensors, micro-electro-mechanical systems and gyroscopic compasses.

4. A pool cleaner which moves on a bottom and/or sidewall surface of a swimming pool according to a scanning algorithm, the pool cleaner comprising:

a. a housing;

b. a power cable extending from the housing to a remote power supply;

c. an on-board memory device for storing the scanning algorithm, a start-up reference heading and a plurality of actual directional headings taken while the pool cleaner is moving after start-up, and the difference between the reference heading and the actual directional headings;

d. an electronic compass on board the pool cleaner that is coupled to the memory device for determining an initial reference directional heading and subsequent actual directional headings that are calculated by the microprocessor to correct a directional heading for any pitch and/or roll of the pool cleaner and transmitting the reference heading and actual directional headings to the memory device, wherein the electronic compass includes a tilt sensor for sensing the pitch and/or the roll of the electronic compass and the actual directional headings are directional headings corrected for any pitch and/or the roll;

e. a microprocessor operatively coupled to the memory device and the electronic compass for (i) comparing the subsequent actual directional headings of the pool cleaner with the reference directional heading stored in the memory device, (ii) transmitting the result of each comparison in the form of a positive or negative value to represent, respectively, a right or left deviation from the reference directional heading in degrees, and (iii) registering the completion of an entire turn either in a number of right turns or a number of left turns depending upon the left or right deviation from the reference directional heading, when the cumulative difference between the subsequent true directional headings and the reference directional heading is equal to or greater than 360° or a multiple of 360°; and f. a directional controller on board the housing operatively coupled to the microprocessor for turning the pool cleaner to the left when the number of right turns is greater than the number of left turns and turning the pool cleaner to the right when the number of left turns is greater than the number of right turns, until the number of the right and left turns are equalized, thereby minimizing undesired twists and coils in the power cable.

5. The pool cleaner of claim 4 in which the reference heading is tilt-compensated.

6. The pool cleaner of claim 4 in which the scanning algorithm is interrupted for the purpose of equalizing the number of right and left turns when the difference is equal to or greater than a predetermined number of turns.

7. The pool cleaner of claim 6 in which the scanning algorithm is interrupted when the difference between right and left turns is equal to at least two.

8. The pool cleaner of claim 4 in which the electronic compass is selected from the group consisting of magnetic sensors, micro-electro-mechanical systems and gyroscopic compasses.

9. A method for preventing or minimizing undesired twists and coils of a tethered cable attached to a pool cleaner moving along the bottom and/or sidewall surfaces of a pool during a cleaning cycle, said cleaner including a microprocessor for executing a scanning algorithm for controlling the directional heading of the pool cleaner and responding to signals received from directional sensing circuitry including a tilt sensor and a magnetic field sensor, the method comprising steps of:

a) sensing, by the magnetic field sensor, directional deviations of the cleaner with respect to a straight path of movement, said directional deviations including clockwise and counter-clockwise deviations from the straight path;

b) sensing, by the tilt sensor, the pitch and/or the roll of the cleaner and determining the actual directional headings of the pool cleaner, the actual directional heading being a pitch and/or roll compensated heading that corrects the directional heading for any pitch and/or roll experienced by the pool cleaner while moving;

c) communicating directional deviation information from the magnetic field sensor to the microprocessor;

d) storing the number of clockwise and counter-clockwise turns made by the cleaner in memory of the directional sensing circuitry;

e) comparing the number of clockwise and counter-clockwise turns made by the cleaner and registering the difference in the number of turns in each direction; and f) turning the pool cleaner clockwise when the number of counter-clockwise turns exceeds a predetermined number of clockwise turns, and turning the pool cleaner counter-clockwise when the number of clockwise turns exceeds a predetermined number of counter-clockwise turns so as to equalize the number of turns in each direction, thereby minimizing undesired twists and coils in the tethered cable.

10. The method of claim 9 wherein the scanning algorithm is interrupted when the difference between the number of clockwise and counter-clockwise turns made by the cleaner is greater than the predetermined number.

11. The method of claim 9, wherein the tilt sensor indicates the orientation of the directional sensing circuit in pitch/roll axes, the orientation data being communicated to the directional sensing circuitry to determine whether the orientation of the magnetic field sensor will prevent accurate directional measurement.

12. The method of claim 9, wherein the tilt sensor indicates the orientation of the directional sensing circuit in pitch/roll axes and transmits information to the directional sensing circuitry to compensate for errors in measurement caused by a deviation of the magnetic field sensor from a horizontal attitude.

13. A pool cleaner which moves on a bottom and/or sidewall surface of a swimming pool according to a scanning algorithm, the pool cleaner comprising:

a. a housing having at least a pair of rotational support members for moving said cleaner along the surface of the pool;

b. a power cable extending from the housing for receiving electrical power from a remote power supply;

c. at least one motor for rotating said rotational support members;

d. directional sensing circuitry for sensing movement deviations of the pool cleaner with respect to a straight line path, said directional sensing circuitry including an electronic compass and a tilt sensor for sensing the pitch and/or roll of the cleaner and a microprocessor for receiving a signal from the electronic compass corresponding to the directional heading and for receiving a signal from the tilt sensor corresponding to any pitch and/or roll experienced by the pool cleaner, and determining an actual directional heading that corrects the directional heading for the pitch and/or roll;

e. a directional controller having memory for storing the scanning algorithm and a processor operatively coupled to the directional sensing circuitry for (i) receiving, from said directional sensing circuitry, communication signals representing clockwise and counter-clockwise turns made by the cleaner; (ii) comparing the number of clockwise and counter-clockwise turns made by the cleaner; (iii) registering the number of clockwise and counter-clockwise turns made by the cleaner, and calculating the difference therebetween; and (iv) controlling power to the at least one motor to turn the pool cleaner counter-clockwise when the number of clockwise turns exceeds the number of counter-clockwise turns by a pre-determined amount and turning the pool cleaner clockwise when the number of counter-clockwise turns exceeds the number of clockwise turns by a predetermined amount, wherein the twisting of the power cable during cleaning does not exceed a predetermined operational limit, thereby minimizing undesired twists and coils in the power cable.

14. The pool cleaner of claim 13 in which the directional sensing circuit comprises a magnetic field sensor.

15. The pool cleaner of claim 13, wherein the directional sensing circuitry includes an electronic compass which is selected from the group consisting of magnetic sensors, micro-electro-mechanical systems and gyroscopic compasses.

* * * * *